US006688775B2

(12) United States Patent
Schuller et al.

(10) Patent No.: US 6,688,775 B2
(45) Date of Patent: Feb. 10, 2004

(54) SUPPORT DISK FOR A SUPPORT DISK BEARING FOR SPIN ROTORS

(75) Inventors: Edmund Schuller, Ingolstadt (DE); Manfred Knabel, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/833,086

(22) Filed: Apr. 11, 2001

(65) Prior Publication Data

US 2002/0025094 A1 Feb. 28, 2002

(30) Foreign Application Priority Data

Apr. 13, 2000 (DE) ..... 100 18 440

(51) Int. Cl.[7] ..... F16C 13/00; D01H 1/24
(52) U.S. Cl. ..... 384/549; 57/406
(58) Field of Search ..... 384/549; 57/406, 57/407, 405, 103

(56) References Cited

U.S. PATENT DOCUMENTS

| | | | | |
|---|---|---|---|---|
| 4,667,464 A | | 5/1987 | Stahlecker et al. | |
| 4,713,932 A | * | 12/1987 | Zott | 57/406 |
| 4,892,422 A | * | 1/1990 | Stahlecker | 384/295 |
| 4,893,946 A | * | 1/1990 | Tesh et al. | 384/549 |
| 5,178,473 A | | 1/1993 | Oexler et al. | |
| 5,423,616 A | | 6/1995 | Götz | |
| 5,904,038 A | * | 5/1999 | Stahlecker | 384/549 |
| 6,220,761 B1 | | 4/2001 | Bock et al. | |
| 6,263,657 B1 | | 7/2001 | Fietz | |
| 6,269,622 B1 | * | 8/2001 | Simon | 57/406 |

FOREIGN PATENT DOCUMENTS

| | | |
|---|---|---|
| DE | 3342768 | 6/1985 |
| DE | 3826851 | 2/1990 |
| DE | 4121387 | 1/1993 |

OTHER PUBLICATIONS

German Search Report, dated Oct. 10, 2000.
European Search Report, dated Aug. 17, 2001.
English Language Abstract for DE 3342768.
English Language Abstract for DE 3826851.
English Language Abstract for DE 4121387.
Article: Neumüller, Otto–Albreicht: Römpps Chemie–Lexikon, pp. 1558–1559.
Article: J. Weir & R.C. Berkey: Carboxylierter Nitrilkautschuk—Eigenschaften und Anwendungen.

* cited by examiner

*Primary Examiner*—Thomas R. Hannon
(74) *Attorney, Agent, or Firm*—Dority & Manning

(57) ABSTRACT

Proposed is a support disk bearing for an open-end spinning rotor. The support disk possesses a body, which, on its circumferential surface, is designed to receive a cover layer. The cover layer is comprised of rubber, in particular nitrile rubber (NBR). In an advantageously favorable formulation, the cover layer contains an additive for the reduction of its electrical resistance.

16 Claims, 3 Drawing Sheets

143
14
30

143
30

143
5
14
30

143
14
3

143
5
14
30

SUPPORT DISK FOR A SUPPORT DISK BEARING FOR SPIN ROTORS

BACKGROUND OF THE INVENTION

The present invention concerns a support disk for a support disk bearing for an open-end spin rotor.

Generic conventional support disks have been disclosed by DE 33 24 129 A1 describing a bearing for spin rotors. The support disks comprise a body, which, for instance, is constructed of plastic or metal and which, on its circumference, possesses a plastic ring that forms the running surface for the rotor shaft that it bears. The plastic ring, in this case, is applied by spraying on to the body. In the present state of the technology, the material used on the circumference of the disk with the plastic ring and which is driven by the shaft is polyurethane polymer.

This elastic plastic ring forming the running surface of the rotor shaft has the characteristic that it possesses damping qualities, so that oscillations may be damped during a vibratory period in the run of the spin rotor. Such vibratory periods can occur, for instance, because of imbalances or through impacts with the driving tangential belts. With the known support disk bearings and support disks equipped with the circumferential surface made of polyurethane, rotational speeds of the rotor shaft of up to 110,00 RPM are possible.

Besides the mentioned advantages, the circumferential polyurethane covering of the support disk also has the drawback of excessive wear. Because of the continual deformation, i.e., compression and expansion of the running surface, this component is heated to such a degree, that complete destruction of the layer occurs. In order to repress this behavior of the support disk, it is a conventional practice within the state of the technology to place a cooling groove in this outer layer. This cooling groove is made known by U.S. Pat. No. 5,178,473.

Along with this breakdown, the known support disks are deficient in that the polyurethane running surface separates itself from the base part of the support disk, whereby destruction of the support disk follows.

In order to avoid problems of this nature, it is a known practice in the state of the technology for such support disks that have the plastic cover layer applied onto the body to provide a form fit connection between the body and the plastic cover layer as seen in a radial direction of the support disk. A support disk of this kind is described in DE 42 27 489 A1. From DE 198 24 286 A1, a support disk has been made known, which is provided with a cleaning groove, as well as a cooling groove. DE 198 24 286 A1 also provides further measures so that, during an operational run of the rotor spinning apparatus, contamination is prevented from getting on the rotor shaft, which would cause additional maintenance.

Experience has shown that the support disks of the state of the technology exhibit faults when installed and, in spite of the known measures, have only a very restricted operational life, which limits their employment in modem rotor spinning machines. The stresses thereby brought about lead to an early failure of the support disks so that, besides the high expenditures for the necessary replacement parts, the productivity of the spinning machine is lessened because of the required maintenance work.

OBJECTS AND SUMMARY OF THE INVENTION

Thus, a principal purpose of the present invention is to eliminate the disadvantages of the state of the technology, and to make available support disks, which provide bearings suitable for open-end spin rotors even at the most extreme speeds of rotation without the detriment of an insufficient length of operational life. Additional objects and advantages of the invention will be set forth in part in the following description or may be obvious from the description, or may be learned through practice of the invention.

This principal purpose of the present invention is achieved through a support disk with a circumferential surface having a cover layer made of rubber.

By means of the formulation of the support disk in accord with the invention, a secure connection is advantageously created between the body and the running surface of the support disk. This connection resists such forces incurred by the in-and-out flexing of the cover layer. Even at the highest speeds of rotation and loadings, the loosening of the applied circumferential layer from the body of the disk does not occur.

Furthermore, the support disk constructed in accord with the invention possesses very good rolling characteristics for the carried rotor shaft. In this way, an unsteady phase in the running behavior of the rotor is substantially ameliorated by the excellent damping properties of the support disk, and vibrations are damped.

The damping operation in the circumferential cover layer of the support disk advantageously can be carried out by the layer without detriment to the quality of the running surface. In particular, the most favorable damping characteristics of the invented cover layer for the running surface of the support disk make it possible to hold the thickness of the cover layer of the support disk to a minimum. This has the additional virtue in that the heat removal from the cover layer is alleviated. The flexing brought about in the cover layer on this account does not lead to excessive heating of the cover layer. This advantage substantially increases the operational life of the cover layer as well as that of the support disk.

In an advantageous development of the invention, the cover layer of the support disk is furnished with a cooling groove for even better dissipation of heat from the cover layer during operation. This cooling groove further increases the wear resistance of the support disk.

Providing a design of the body with circumferential profiling in a radial direction is a favorable design to bring about a form fit connection between the body and the cover layer. Even when this may not seem necessary due to a current application, such profiling does enable future higher load demands to be met by the support disk.

By the design of the cover layer with a cleaning groove for the suppression of contaminant deposits on the rotor shaft, disturbances in operation are reduced. Such deposits are also hindered by the fact that the cover layer of the support disk has a low electrical resistance, advantageously less than $1.0\times10^9$ Ohm. In order to achieve this, the rubber material advantageously is treated with an additive for the increase of its electrical conductivity.

In an advantageous development of the invention, the cover layer on the support disk consists of nitrile rubber ([acrylo]nitrile-butadiene rubber), hereinafter, "NBR".

This material has especially favorable mechanical characteristics, which cause it to be practically abrasion proof in rough operational conditions. Even better advantageous properties are possessed by the rubber H-NBR.

This rubber can contain additives, so that it requires no special aging, which is required, for instance, of the polyurethane used in practice in accord with the state of the technology. NBR or HNBR, as a result of these additives, has the characteristics of an already aged material and thus possesses uniform, unchanging properties from the beginning.

Fortunately, there is found in an advantageous development of the invention, a rubber with a tensile strength to meet at least 28 $N/mm^2$. Advantageously, a rubber is available for use with a Shore Hardness of A 85 to 105. Thereby, favorable damping values can be achieved for the cover layer. Just as advantageous is a rubber with a hardness between Shore D 45 to 70. The use of a rubber for the support disk with an elasticity of at least 29% assures a high resistance to wear and good damping.

If the support disk has one or more grooves on the circumference of the cover layer, then, in an advantageous manner, the support disk cover layer can endure even the highest loadings. The groove can fulfill several purposes. For example, the groove can be used for cooling the cover layer or for the cleaning of the shaft of the open spin rotor. Moreover, by means of the installation of the grooves, the rolling contact friction of the shafts against the support disks is lessened.

If the grooves penetrate to the body of the support disk, that is, if the cover layer is essentially made of a plurality of individual elements, independent of one another, then a highly satisfactory cooling of the cover layer and the support disk is assured. The holding qualities of the rubber of the cover layer onto the body of the support disks, especially when this is made of aluminum, are particularly good. Thus, it is possible to fasten the cover layer without lateral restraint directly to the support disk on the circumferential surface. However, for certain technical manufacturing reasons, certain small lateral restraint may be necessary. The scuffing off of the cover layer from the support disks is not to be feared with the invented formulation of the cover layer within foreseeable loadings.

If the cover layer has a thickness of less than 4 mm or if it is less than 1.9 times the depth of the deepest groove, then the cover layer possesses an especially good relationship in reference to its structural strength and the cooling and cleaning effects of the groove.

Respectively, in accord with each instance, it can be advantageous if one or more cleaning grooves are placed on the cover layer of the support disk.

If the body has been surface treated, especially if the body is of aluminum and has been anodized, then other advantages appear. By means of the surface treatment, damage to the material of the body, particularly by oxidation, is prevented. Besides this, by means of the surface treatment, characterizing colorations are possible, so that the installation of different support disks can be chromatically designated in a simple way and thus unwanted exchanges can be avoided. By means of the special characteristics of the material of the invented cover layer of the support disks, it is even possible to put an anodized surface in place after the installation of the circumferential cover layer. By means of the anodized surfacing, that is, the anodizing of the support disk with the cover layer in place, the circumferential cover layer is not affected and its action is not impaired. The anodizing can take place after the finishing work of the support disk.

Invented support disks with outside diameters between 50 and 80 mm have performed exceptionally well for installation in the support bearing system for spin rotors.

The contact surface between cover layer and rotor shaft shows a width of between 4 and 12 mm. This width is sufficient to see that first, a predominantly slip-free rolling contact of the rotor shaft on the support disk is actuated and, second, the rolling resistance is held to the least possible amount.

For a minimum width of the cover layer, a value of around 2 mm is particularly recommended. At this width, it is even possible to work out a direct fastening of the cover layer on the circumference of the body without lateral restraint between the body and the cover layer. When the body is aluminum, a particularly sufficient hold between the invented cover layer and the circumference is obtained.

Beyond this, the 2 mm is enough to avoid a lateral kinking of the cover layer. In the following, the invention will be described with the aid of illustrative presentations.

DETAILED DESCRIPTION

Figure 1:
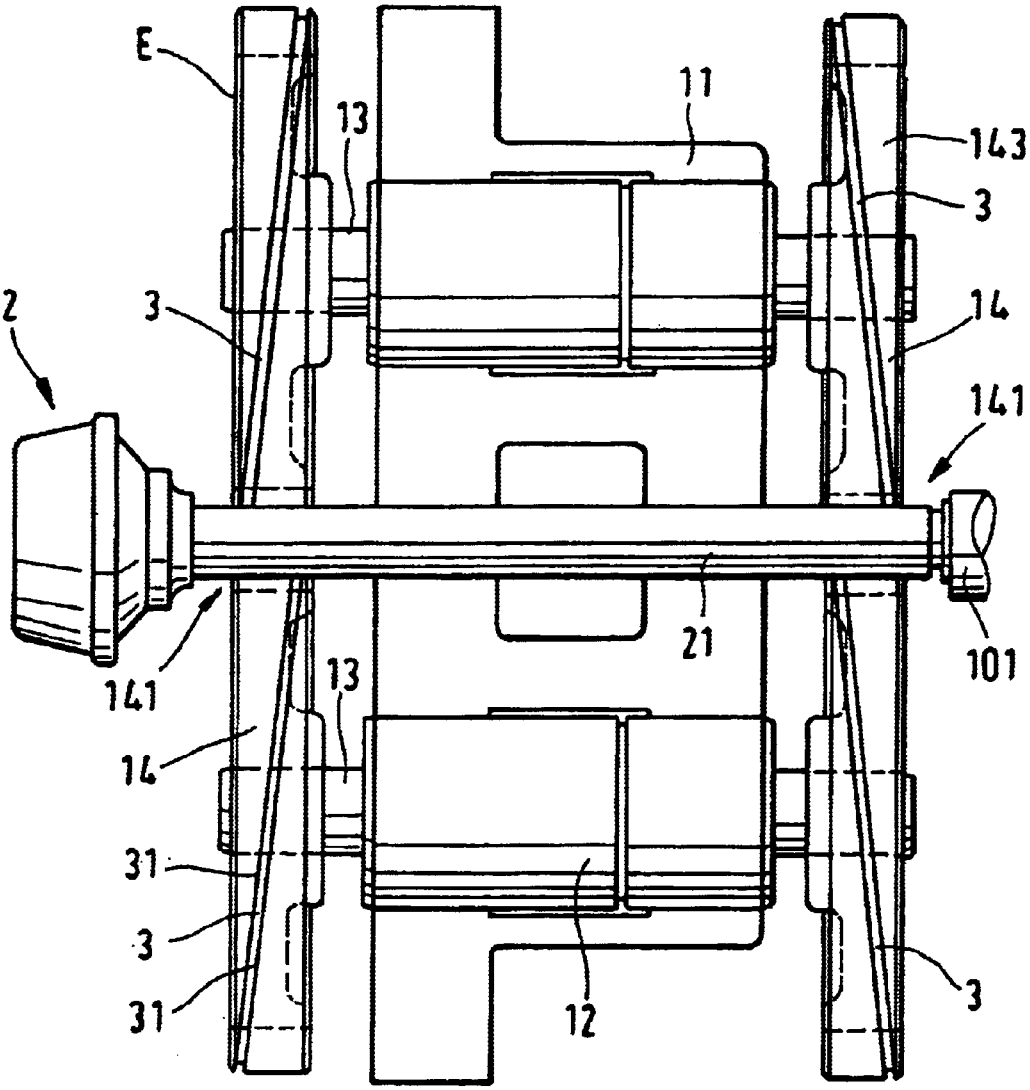
FIG. 1 shows a presentation of the principles of a bearing system for an open-end spin rotor.

FIG. 1 shows the principles of a bearing system 1 for an open-end spin rotor 2, as this is standard where such open-end equipment is installed. The bearing system is comprised generally of a bearing block 11 which carries the support disk bearings 12. The support disk bearings 12 each carry one shaft 13, which, on each of their ends, a support disk 14 is connected by press fit. Together, the support disks 14 form a disk pair so that a wedge shaped opening 141 is formed between them. The support disks carry the rotor shaft 21 of the open-end spin rotor 2. If the open-end spin rotor 2, for instance, is driven by a tangential belt (not shown), it rolls in the wedge shaped opening 141 on the support disks 14. Thereby, these are set into rotary motion. The support disks 14 are provided with a cleaning groove 3, which traverses with its edges 31 along the contact line of the rotor shaft upon the rotation of the support disks 14. The cleaning groove 3 is installed in the cover layer 143 in the form of an endless groove.

Since the run of the rotor shaft connected to the support disks is not entirely slipfree, it is assured that the groove edge 31 reaches every position of the rotor shaft and keeps this shaft free from contaminating deposits.

The shafts 13, which serve as bearing for the support disks 14, are set in their own bearings not parallel to one another, but slightly inclined so that an axial thrust will be exercised on the rotor shaft 21 by the support disks 14. The rotor shaft 21 is axially supported by the axial bearing 101 in a known manner. This axial bearing, for example, can be designed as a thrust bearing as indicated in FIG. 1 in the form of an aerostatic axial bearing.

The positioning of the rotor shaft 21 in the wedge shaped opening 141 of the support disks 14 results in a relatively high pressure on the rotor shaft against the cover layer 143 of the support disks 14. This pressure is produced since the tangential belts running over the rotor shaft 21 are pressed on their own account with a radial force on the rotor shaft 21. The direct pressure is necessary in order to hold the slippage between the tangential belts and the rotor shaft 21 as low as possible. This pressure would permit the rotor shaft 21 and thus the open-end spin rotor 2 to be driven without loss. This pressure must be absorbed by the circumferential cover layer 143 of each support disk 14. Because of the fact that the support disks rotate with the rotor shaft 21, an alternating pressure force is exercised on the cover layer 143, which further stresses the cover layer 143. The stressing due to this alternating pressure leads to a heating of the cover layer 143 and therewith a thermal load is added.

Besides this type of stress to which the cover layer 143 is subjected, a continual frictional contact of the rotor shaft 21 perpendicular to the plane of the support disk 14 is exerted against the cover layer 143. The friction contact has its origin, as already mentioned above, in the arrangement of the two shafts 13 to each other. The frictional contact by means of the rotor shaft leads to a stressing of the surface of the support disk in a mechanical way and again leads to a heating of the cover layer 143 produced by this situation.

Figure 2:
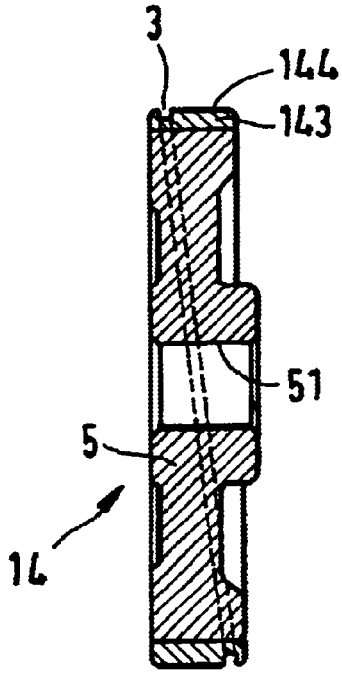
FIG. 2 shows a cross-section through a support disk of the bearing system of FIG. 1.

The support disk 14, shown in FIG. 2 in cross-section, possesses a cleaning groove 3 in the cover layer 143. The cover layer 143 forms on its circumference the running surface 144 on which the rotor shaft 21 rolls. The support disk 14 comprises a body 5, which, for example, can be aluminum, whereupon it could be made by precision molding, or it can also be plastic. The support disk 14 possesses in its center a boring 51 by means of which it is fastened to the shaft 13 of a support disk bearing 12 by means of a press fit (see FIG. 1). In the area of the transition of the body 5 to the cover layer 143, the outer circumference of the body 5 is shaped (not shown) in a special manner, for instance, V-shaped or hammer shaped. This shaping leads to an improved adherence between the body and the cover layer 143, so that a better holding power between the body 5 and the cover layer 143 can be assured.

In a favored construction, the body 5 is designed so that a sufficient depth of the cover layer is available to accommodate a cleaning groove.

The assured secure fastening of the cover layer 143 on the body 5 of the support disk is carried out not only by means of a form fit connection between the body 5 of the disk 14 and the cover layer 143, as shown in FIG. 2, but also by inherent bonding between the cover layer 143 and the body 5. This bonding in the case of a support disk constructed in accord with the invention is essentially greater than is found in support disks in which the cover layer 143 is made of polyurethane. The invented cover layer of rubber has inherently a substantially higher holding power on the body than do cover layers conventionally used in the state of the technology. Furthermore, the invented support disk cover layer of rubber has a lesser tendency to form shrinkage cavities, and thus, its adhesiveness is once more increased.

Because of the advantageous lesser inclination of the cover layer of rubber, particularly NBR or HNBR, to form shrinkage cavities or piping, it becomes possible to apply this material in a thinner layer on the outer circumference of the support disk body.

Figure 3:
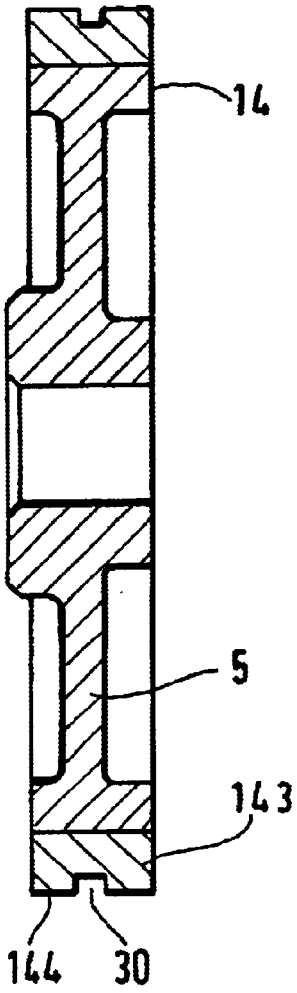
FIG. 3 shows a cross-section through a support disk with a flat circumferential surface.

The support disk 14, depicted in a cross-sectional view in FIG. 3, possesses a body 5, which has a smooth cylindrical shaped surface as its circumference upon which the rubber cover layer 143 is placed in accord with the invention. Because of the particular physical properties of this rubber, in particular, its favorable tenacity to the body material, it is possible without the body 5 being profiled on the circumference to make a secure bonding between the cover layer 143 and the body 5. Further, the tenacity can be increased if necessary by bonding means and/or roughening the contact surface. The cover layer 143, shown in FIG. 3, possesses a groove 30 running centrally around the circumference. This groove 30 has the task of a cooling groove for the cooling of the cover layer 143. Such grooves 30 applied for cooling are common in the state of the technology.

The thickness of the cover layer 143, as shown in FIG. 3, allows further design possibilities. In accord with the respective application of various installed rubber cover layers, it is possible to construct the cover layers substantially thinner than the state of the technology requires for polyurethane cover layers. By the thinner designed cover layer, the cover layer 143 advantageously contains a lesser mass, whereby its bonding to the body surface experiences an essentially lesser stress from centrifugal action than does the cover layer of the state of the technology. In spite of its being thinner in the case of the invented rubber cover layer 143, the required characteristics for the damping of the rotor shaft during rolling action remain. Also, by the diminishing of the thickness, the heat caused by the compression and release of the substance is closer to the body 5, so that heat dissipation, especially when the support disk bodies are of metal, is essentially improved. This improved heat dissipation increases the operational life expectancy of the cover layer 143 and also the support disk 14.

The favorable characteristics of the support disk cover layer 143 make possible a further design improvement, especially concerning the running surface 144, since the cover layer 143 in accord with the invention is more resistant, that is, has a greater capability to minimize erosive damage. Thus, narrower support disks can be installed whereby the bearing assembly advantageously can be built smaller and will have a lesser mass. Also, an advantageous reduction in size of the diameters of the support disks as a result of the invented materials for the running surface is now possible.

Figures 4A, 4B, 4C, 4D, 4E:
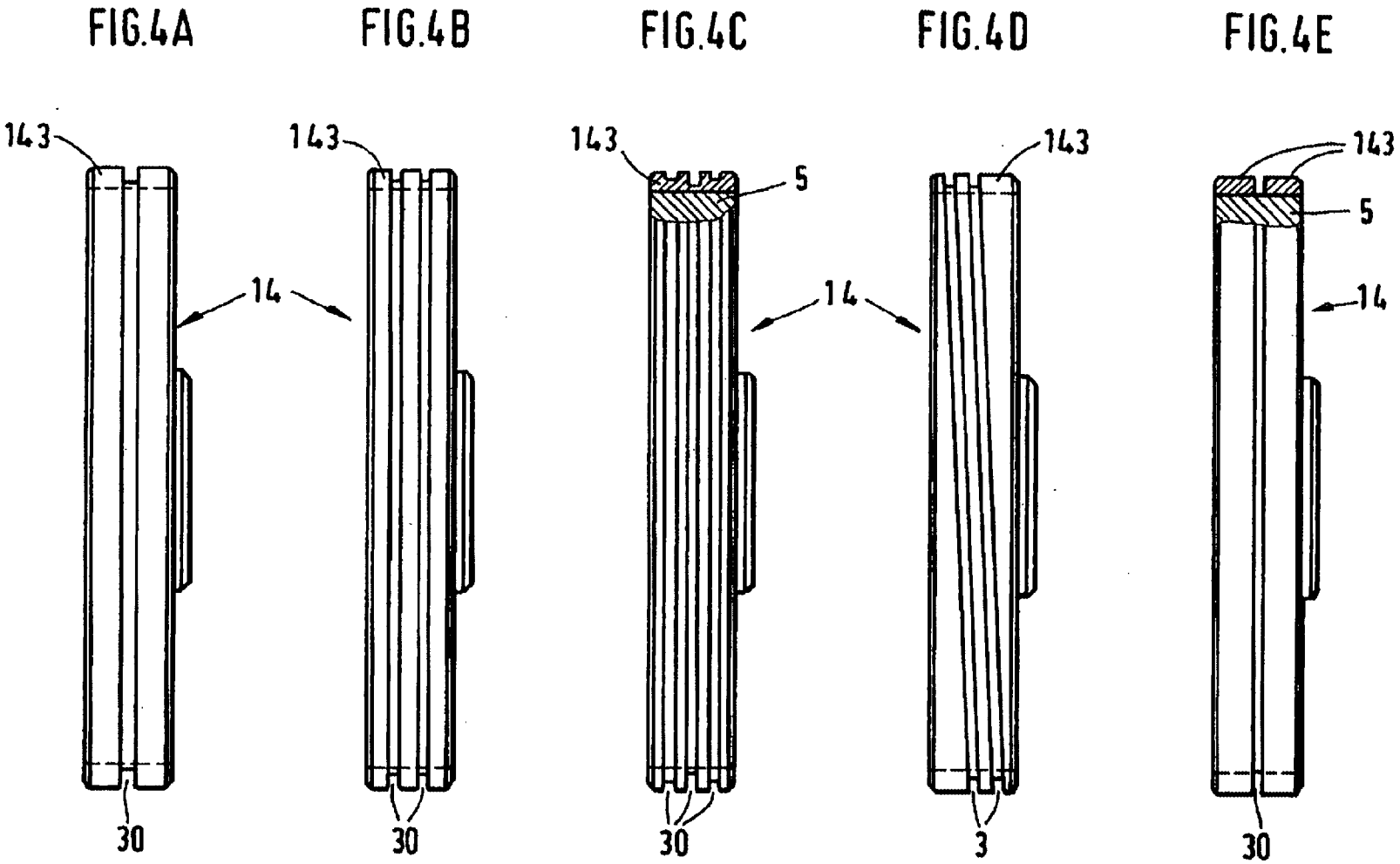
FIG. 4 shows various embodiments of a support disk in accord with the invention.

In FIG. 4, respectively, various embodiments of a support disk in accord with the invention are presented. FIG. 4A shows an embodiment having a groove 30 in a cover layer 143 which nearly penetrates through to the base (dotted line). By the cohesion of the cover layer at its inner circumferential surface, a very stable embodiment is created, since the two part cover layer extending outwardly at its fastening point is supported on both sides.

In FIG. 4B, a support disk 14 is presented which has two circumferential grooves 30. By this means, three support surfaces are created by the cover layer for the rotor shaft.

FIG. 4C depicts an arrangement of three grooves 30 in the support disk cover layer 143. As this cross-section shows, the outer two grooves are formed less deep in the thickness of the cover layer than is the center, third groove. The center groove 30 is, in this case, similar to the groove depicted in FIG. 4A as it is formed to a depth in the cover layer 143 approaching the body surface 5.

In FIG. 4D, cleaning grooves 3 in the cover layer 143 are slanted, in reference to the central axis of the body 5. By this device, an axial thrust is generated on any contaminating deposit on the rotor shaft 21, whereby such contamination is gradually abraded and the rotor shaft 21 in this area is kept nearly free of any deposits of unwanted material.

The arrangement in FIG. 4E shows two individual cover layers 143 in support disk 14. Each of these cover layers 143 is made fast, without contact with the other, on the circumference of the body 5 of the rotor support disk 14. Because of the characteristics of the material of the cover layer 14, a good adherence is secured in this design in which no contact with the body 5 of the support disk 14 is present, or possibly only a very small lateral retention will suffice.

A support disk bearing system is, in general, less sensitive to manufacturing and mounting tolerances than usual, and thereby makes possible a more favorable manufacturing cost. Thus, the possibility becomes evident, that it is not necessary to subsequently spray onto the support disk covering 143 any means of diminishing a lateral stress of the covering. For a precise work-up, principally, only the circumferential surface need be treated by chemical or mechanical profiling.

Further advantages arise from the advantageous material characteristics. Naturally, rubber inherently has a very small electrical conductivity in comparison to the cover layer of the support disk of the state of the technology.

What is claimed is:

1. A support disk used in a support disk bearing system of an open-end spinning machine, said support disk comprising:

a unitary circumferential body fastenable to a bearing shaft, said body having a circumferential outer surface;

a cover layer bonded directly to said circumferential outer surface of said circumferential body, said cover layer having a cover layer circumferential surface contactable with a rotor shaft of an open-end spinning rotor allowing the support disk bearing system to support said open-end rotor in an open-end spin box; and wherein said cover layer is formed at least in part of a nitrile rubber (NBR) material having a hardness between Shore A 85 and 105.

2. A support disk as in claim 1, wherein said rubber possesses a tensile strength of at least 28 $N/mm^2$.

3. A support disk as in claim 1, wherein said rubber possesses an elasticity of at least 29%.

4. A support disk as in claim 1, wherein said cover layer circumferential surface forms at least one groove within said cover layer.

5. A support disk as in claim 4, wherein said groove penetrates to said body.

6. A support disk as in claim 1, wherein said cover layer circumferential surface forms at least one groove for cooling of said cover layer.

7. A support disk as in claim 1, wherein said cover layer circumferential surface forms at least one cleaning groove for cleaning said rotor shaft.

8. A support disk as in claim 1, wherein said cover layer has a thickness of less than 4 millimeters.

9. A support disk as in claim 1, wherein said cover layer has an electrical resistance of a value of less than $1\times10^9$ Ohm.

10. A support disk as in claim 9, wherein said rubber of said cover layer includes an additive which reduces the electrical resistance of said cover layer to a value of less than $1\times10^9$ Ohm.

11. A support disk as in claim 1, wherein said body and said cover layer together have an outer diameter between 50 millimeters and 80 millimeters.

12. A support disk as in claim 1, wherein a contact surface width between said cover layer and said rotor shaft is between 4 millimeters and 12 millimeters.

13. A support disk as in claim 1, wherein the minimum width of said cover layer is 2 millimeters.

14. A support disk as in claim 1, wherein said nitrile rubber is HNBR.

15. A support disk used in a support disk bearing system of an open-end spinning machine, said support disk comprising:

a circumferential body fastenable to a bearing shaft, said body having a circumferential outer surface;

a cover layer operably disposed to said circumferential outer surface of said circumferential body, said cover layer having a cover layer circumferential surface contactable with a rotor shaft of an open-end spinning rotor allowing the support disk bearing system to support said open-end rotor in an open-end spin box and said cover layer circumferential surface forming at least one groove within said cover layer;

wherein said cover layer is formed at least in part of a rubber material; and wherein said cover layer has a thickness of less than 1.9 times the deepest groove.

16. A support disk used in a support disk bearing system of an open-end spinning machine, said support disk comprising:

a circumferential body fastenable to a bearing shaft, said body having a circumferential outer surface;

a cover layer operably disposed to said circumferential outer surface of said circumferential body, said cover layer having a cover layer circumferential surface contactable with a rotor shaft of an open-end spinning rotor allowing the support disk bearing system to support said open-end rotor in an open-end spin box;

wherein said cover layer is formed at least in part of a rubber material; and wherein said body is anodized after the application of said cover layer to said circumferential outer surface of said body.

* * * * *